US008654062B2

(12) United States Patent
Shen

(10) Patent No.: US 8,654,062 B2
(45) Date of Patent: Feb. 18, 2014

(54) MULTIMEDIA SYSTEM AND REMOTE CONTROL DEVICE THEREOF

(75) Inventor: Yun-Hung Shen, Hsinchu (TW)

(73) Assignee: Mstar Semiconductor, Inc., Hsinchu Hsien (TW)

( * ) Notice: Subject to any disclaimer, the term of this patent is extended or adjusted under 35 U.S.C. 154(b) by 1038 days.

(21) Appl. No.: 12/351,338

(22) Filed: Jan. 9, 2009

(65) Prior Publication Data

US 2009/0195524 A1 Aug. 6, 2009

(30) Foreign Application Priority Data

Feb. 1, 2008 (TW) ..... 97103886 A

(51) Int. Cl.
*G09G 3/36* (2006.01)

(52) U.S. Cl.
USPC ..... 345/102; 345/207

(58) Field of Classification Search
CPC ..... G03B 7/00
USPC ..... 345/102, 207; 396/56–59
See application file for complete search history.

(56) References Cited

U.S. PATENT DOCUMENTS

| | | | | |
|---|---|---|---|---|
| 5,815,204 | A * | 9/1998 | Abe et al. | 348/371 |
| 6,172,719 | B1 * | 1/2001 | Kim | 348/655 |
| 7,066,626 | B2 * | 6/2006 | Omata | 362/257 |
| 8,238,968 | B1 * | 8/2012 | Frydman | 455/556.1 |
| 2002/0024529 | A1 | 2/2002 | Miller et al. | |
| 2004/0095402 | A1 * | 5/2004 | Nakano | 346/102 |
| 2005/0249486 | A1 * | 11/2005 | Murray | 396/56 |
| 2006/0078216 | A1 * | 4/2006 | Kaku | 382/254 |
| 2006/0172745 | A1 * | 8/2006 | Knowles | 455/456.1 |
| 2007/0070081 | A1 | 3/2007 | Tang et al. | |
| 2007/0081810 | A1 * | 4/2007 | Schnell | 396/153 |
| 2007/0126727 | A1 | 6/2007 | Chiang | |
| 2007/0146301 | A1 | 6/2007 | Fu et al. | |
| 2007/0279390 | A1 | 12/2007 | Loukianov | |
| 2008/0025558 | A1 * | 1/2008 | Nozawa | 382/100 |
| 2009/0040170 | A1 * | 2/2009 | Nilsson | 345/101 |

FOREIGN PATENT DOCUMENTS

| | | | |
|---|---|---|---|
| CN | 1268684 | A | 10/2000 |
| CN | 1364285 | A | 8/2002 |
| CN | 1767606 | A | 5/2006 |
| CN | 1794044 | A | 6/2006 |
| CN | 1984348 | A | 6/2007 |
| TW | 200714084 | | 4/2007 |
| TW | 200723897 | | 6/2007 |

* cited by examiner

*Primary Examiner* — William Boddie
*Assistant Examiner* — Sahlu Okebato
(74) *Attorney, Agent, or Firm* — Rabin & Berdo, P.C.

(57) ABSTRACT

A multimedia system and a remote control device are provided. The multimedia system includes a remote sensor, a wireless transmitter, and a display apparatus. The remote sensor is used for sensing an environmental luminance. The wireless transmitter is used for transmitting a control signal corresponding to the environmental luminance. The display apparatus includes a light source and a wireless receiver. The display apparatus receives the control signal via the wireless receiver and adjusts a brightness level of the light source based on the control signal.

16 Claims, 2 Drawing Sheets

MULTIMEDIA SYSTEM AND REMOTE CONTROL DEVICE THEREOF

BACKGROUND OF THE INVENTION

1. Field of the Invention

Figure 1A:
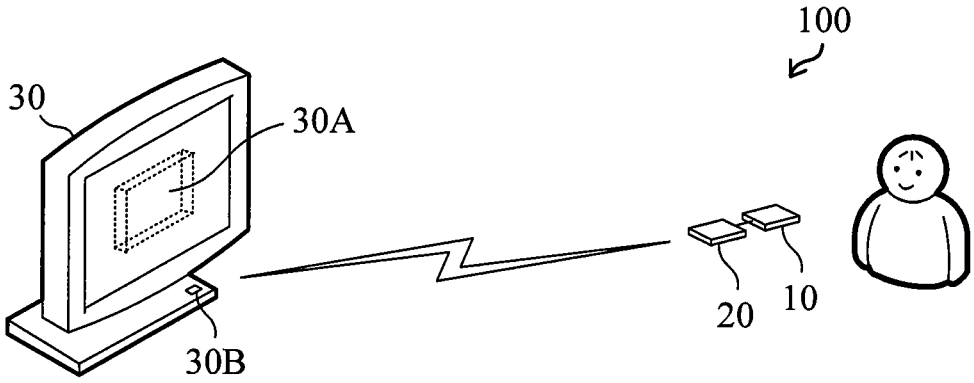

The invention relates to a multimedia system, and more particularly, to a multimedia system capable of adjusting its own settings based on an environmental condition.

2. Description of the Prior Art

In recent years, with the advance of various electronic products, both commercial and household multimedia systems are becoming more popular. The most important hardware in a multimedia system is generally the display apparatus for displaying an image. Therefore, how to enhance the quality of the display apparatus and satisfy users' needs on display characteristics are two important considerations for designers.

Taking the brightness of an image for example, in a relatively bright environment, the brightness of the display need be increased so the observer does not feel that the screen is too dark to see the image clearly. On the contrary, in a relatively dark environment, the bright image may be too intense to the observer's eyes to cause discomfort of the observer. Therefore, most display apparatuses provide a setting interface for users to adjust the brightness as desired.

In order to reduce the inconvenience of manually finding or starting the setting interface, some display apparatuses are provided with external brightness sensors. These display apparatuses can adjust the brightness of the backlight modules according to the detected result of the brightness sensors, i.e., the brightness in the environment of the display apparatuses.

However, because the image on the display apparatus is only a part of what the user visually perceives, the sensed result of the aforementioned brightness sensor may not wholly represent the environmental luminance that the user feels. When there is a distance between the user and the display apparatus, the sensed result of the brightness sensor could be much different from what the user actually feels. For example, when the user sits on a sofa three meters away from the TV screen, the user could be influenced by nearby light sources to feel that the image of the display apparatus, in the relatively darker place, appears to be darker than it in fact is. Thus, the user is still obligated to manually adjust the brightness setting of the display apparatus, such that the brightness sensor fails to fulfill its intended function.

It is to be noted that, the color of an object changes along with the color of the light illuminated thereon. Human eyes can automatically correct the changes resulted by such light, but manufactured sensors lack the correction function. Therefore, images taken or recoded under different lights have different color temperatures. A large number of image processing systems are designed with the function of white balance for correcting the color errors caused by the light to allow the digital image to appear more true to what human eyes observe.

As known by those skilled in the art, determining the color temperature of an image is generally the first step in a white balance procedure. In addition to considering the color temperature of the image, some display apparatuses are also provided with external color temperature detecting devices. The display apparatus is capable of performing the white balance adjustment based on the detected result of the color temperature sensor, i.e., the color temperature in the environment of the display apparatus, so as provide congruity between the image and objects nearby the display apparatus.

However, compared to the aforesaid brightness sensor, the color temperature sensor has the same shortcoming of being incapable of truly reflecting visual perception and needs of the user.

SUMMARY OF THE INVENTION

In order to solve the aforesaid problems, a scope of the invention is to provide a multimedia system and a remote control device comprising a remote sensor. More specifically, the brightness or color temperature sensor according to the invention is provided near the observer, and the sensed result is transmitted to the display apparatus via wireless transmission. Compared to the prior art, in which the sensor is provided as an external part of the display apparatus, the remote sensor according to the invention is capable of providing the environmental condition near the observer as a reference for adjusting associated settings in multimedia systems.

According to a first embodiment of the invention, a multimedia system is disclosed. The multimedia system comprises a remote sensor, a wireless transmitter, and a display apparatus. The display apparatus further comprises a light source and a wireless receiver. The remote sensor is used for sensing an environmental luminance. The wireless transmitter is used for transmitting a control signal corresponding to the environmental luminance. The display apparatus receives the control signal via the wireless receiver and adjusts a brightness level of the light source based on the control signal.

According to a second embodiment of the invention, a multimedia system is further disclosed. The multimedia system comprises a remote sensor, a wireless transmitter, and a display apparatus. The display apparatus is for displaying an image and comprises a wireless receiver. The remote sensor is for sensing an environmental color temperature. The wireless transmitter is for transmitting a control signal corresponding to the environmental color temperature. The display apparatus receives the control signal via the wireless receiver and performs a white balance procedure on the image based on the control signal.

According to a second embodiment of the invention, a remote control device is disclosed. The remote control device comprises a sensor and a wireless transmitter coupled to the sensor. The sensor senses an environmental parameter such as an environmental luminance or an environmental color temperature. The wireless transmitter transmits a control signal corresponding to the environmental parameter. After receiving the control signal from the wireless transmitter, a display apparatus comprising a light source adjusts a brightness level of the light source or performs a white balance procedure for an image based on the control signal.

The advantage and spirit of the invention may be understood by the following recitations together with the appended drawings.

BRIEF DESCRIPTION OF THE APPENDED DRAWINGS

Figure 1B:
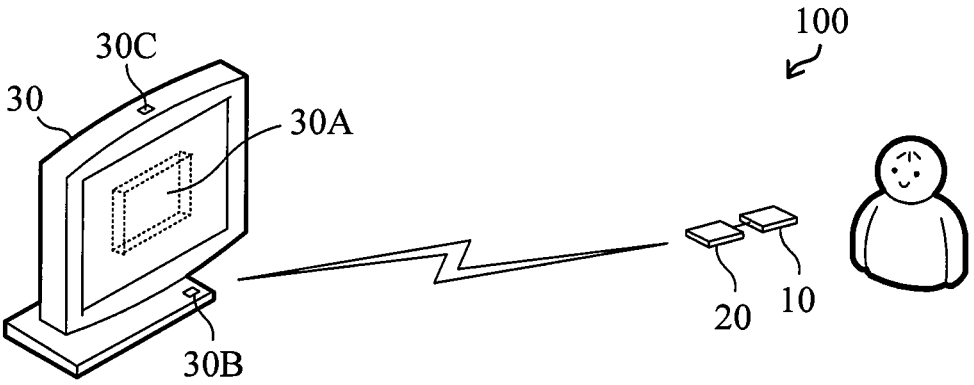

FIG. 1(A) and FIG. 1(B) are schematic diagrams illustrating a multimedia system according to a first embodiment of the invention.

Figure 2A:
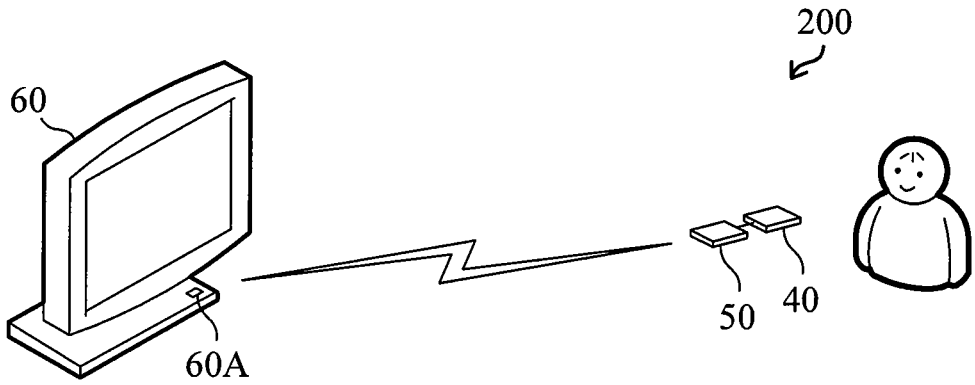
Figure 2B:
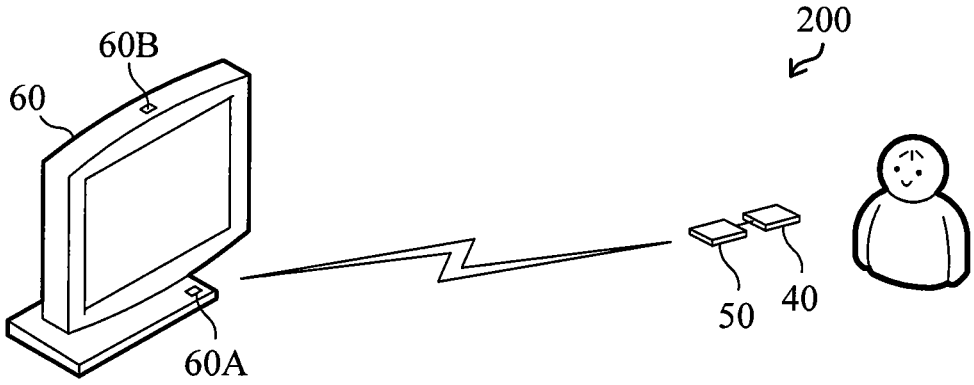

FIG. 2(A) and FIG. 2(B) are schematic diagrams illustrating a multimedia system according to a second embodiment of the invention.

DETAILED DESCRIPTION OF THE INVENTION

According to a first embodiment of the invention, a multimedia system is disclosed. FIG. 1(A) is a schematic diagram of the multimedia system. A multimedia system 100 comprises a remote sensor 10, a wireless transmitter 20, and a display apparatus 30. As shown in FIG. 1(A), the display apparatus 30 further comprises a light source 30A and a wireless receiver 30B.

In this embodiment, the display apparatus 30 may be any display apparatus capable of adjusting the brightness level of light source 30A. Therefore, the light source 30A may be a light-emitting diode (LED) lamp or a cold cathode fluorescent lamp (CCFL) provided in the backlight module of a flat-panel display.

The wireless receiver 30B receives a signal transmitted from the wireless transmitter 20 on condition that the wireless receiver 30B and the wireless transmitter 20 utilize a same communication protocol. For example, the communication protocol may be a short-distance wireless protocol such as ZigBee or Bluetooth. In addition, the wireless transmitter 20 and the wireless receiver 30B also may communicate with each other via an infrared (IR) signal.

The remote sensor 10 senses an environmental luminance of its nearby surroundings. The wireless transmitter 20 transmits a control signal corresponding to the environmental luminance. In practical applications, the remote sensor 10 may be provided near where the user usually rests when using the display apparatus 30, such as a surface of a sofa, a tea table, a cabinet, or a nearby wall.

According to the invention, the remote sensor 10 and the wireless transmitter 20 may both be integrated in a remote control device of the multimedia system 100. In brief, the detected result of the remote sensor 10 is the environmental luminance near the user. In practical applications, the control signal transmitted from the wireless transmitter 20 may be a brightness value detected by the remote sensor 10 or a converted control signal corresponding to the brightness level of the light source 30A.

After receiving the control signal from the wireless transmitter 20 via the wireless receiver 30B, the display apparatus 30 is facilitated to adjust the brightness level of the light source 30A based on the control signal. Even though the brightness at a position of the user is different from that of the display apparatus 30, since the screen brightness of the display apparatus 30 can be appropriately adjusted according to the position of the user and the environment, display effects satisfying the user's need can be provided.

As shown in FIG. 1(B), the display apparatus 30 further comprises a near-end sensor 30C for sensing a neighboring luminance around the display apparatus 30. Since the near-end sensor 30C may be directly integrated in the circuit of the display apparatus 30, the display apparatus 30 can then receive the neighboring luminance from the near-end sensor 30C via wired transmission.

According to the invention, apart from the environmental luminance sensed by the remote sensor 10, when adjusting the brightness level of the light source 30A, the display apparatus 30 may further take into consideration the neighboring luminance sensed by the near-end sensor 30C. In other words, the display apparatus 30 may adjust the light source 30A based on both the environmental luminance and the neighboring luminance.

According to a second embodiment of the invention, a multimedia system is disclosed. FIG. 2(A) is a schematic diagram of a multimedia system 200 comprising a remote sensor 40, a wireless transmitter 50, and a display apparatus 60.

The remote sensor 40 senses an environmental color temperature of its surroundings. The wireless transmitter 50 transmits a control signal corresponding to the environmental color temperature. In practical applications, the remote sensor 40 may be provided near where the user usually rests when the user uses the display apparatus 60, or be integrated in a remote control device of the multimedia system 200.

The display apparatus 60 displays an image and comprises a wireless receiver 60A. The display apparatus 60 receives the control signal from the wireless transmitter 50 via the wireless receiver 60A and performs a white balance procedure on the image to be displayed based on the control signal. By adopting the environmental color temperature near the user, the multimedia system 200 is capable of providing congruity between the image displayed on the display apparatus 60 and the whole visual perception of the user.

In practical, the remote sensor 40 may comprise a set of RGB light sensors and an analog-to-digital converter (ADC). The ADC is used for converting a sensed result of the set of RGB light sensors into the control signal.

In the white balance procedure, the display apparatus 60 may adjust the gray levels of the pixels in the image to be displayed according to the environmental color temperature sensed by the remote sensor 40. If the display apparatus 60 uses LED lamps or similar luminous means as its light source, the white balance procedure may also be performed through adjusting the brightness level of the light sources corresponding to each pixel.

As shown in FIG. 2(B), the display apparatus 60 can further include a near-end sensor 60B for sensing a neighboring color temperature around the display apparatus 60. For that the near-end sensor 60B may be directly integrated in the circuit system of the display apparatus 60, the display apparatus 60 can receive the neighboring color temperature from the near-end sensor 60B via wired transmission.

Besides the environmental color temperature sensed by the remote sensor 40, when performing the white balance procedure, the display apparatus 60 may also take the neighboring color temperature sensed by the nearby sensor 60B into consideration. In other words, the display apparatus 60 can perform the white balance procedure based on both the environmental color temperature and the neighboring color temperature.

In a third embodiment according to the invention, the remote sensor 10 and the wireless transmitter 20 shown in FIG. 1(A) are integrated in a remote control device of a display apparatus. More specifically, in addition to original functions such as selecting channels and adjusting volume of the display apparatus, the remote control device can further provide the functions of sensing the environmental luminance and transmitting a corresponding control signal.

A fourth embodiment according to the invention is also a remote control device cooperating with a display apparatus. The remote control device comprises the remote sensor 40 and the wireless transmitter 50 shown in FIG. 2(A). The operation of this embodiment is similar to that of the aforesaid second embodiment and is omitted for brevity.

The remote sensor according to the invention may be implemented to all kinds of multimedia systems including display apparatuses. As described in the aforesaid embodiments, the luminance or color temperature sensor according to the invention is provided near the observer. The environmental condition near the observer may then be transmitted to the display apparatus via wireless transmission and used as a reference for adjusting the multimedia system. Compared to the prior art, in which sensors are provided as external parts of the display apparatus, the remote sensor of the invention is capable of truly reflecting visual perception and needs of the user.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A multimedia system, comprising:

a remote sensor for sensing a user environmental luminance, the remote sensor being provided near a user to sense the user environmental luminance around the user;

a wireless transmitter, coupled to the remote sensor, for transmitting a control signal corresponding to the user environmental luminance; and a display apparatus, comprising a wireless receiver receiving the control signal and a light source providing light for the display apparatus, the display apparatus further comprising a near-end sensor for sensing a neighboring luminance;

wherein the display apparatus receives the control signal from the wireless transmitter and the neighboring luminance from the near-end sensor via wired transmission, and adjusts a brightness level of the light source according to the control signal and the neighboring luminance to achieve a brightness adjustment for the display apparatus.

2. The multimedia system of claim 1, wherein the light source comprises a cold cathode fluorescent lamp (CCFL) or a light emitting diode (LED) lamp.

3. The multimedia system of claim 1, wherein the remote sensor and the wireless transmitter are integrated in a remote control device capable of communicating with the display apparatus.

4. The multimedia system of claim 1, wherein the wireless transmitter communicates with the wireless receiver via an infra-red (IR) signal or a radio frequency (RF) signal.

5. A multimedia system, comprising: a remote sensor, for sensing a user environmental color temperature, the remote sensor being provided near a user to sense the user environmental color temperature;

a wireless transmitter, coupled to the remote sensor, for transmitting a control signal corresponding to the user environmental color temperature; and a display apparatus, comprising a wireless receiver receiving the control signal and a light source providing light for the display apparatus, the display apparatus further comprising a near-end sensor for sensing a neighboring color temperature;

wherein the display apparatus receives the control signal from the wireless transmitter and the neighboring color temperature from the near-end sensor via wired transmission, and adjusts a brightness level of the light source and performs a white balance procedure on an image to be displayed according to the received control signal and the neighboring color temperature to achieve a white balance adjustment for the display apparatus.

6. The multimedia system of claim 5, wherein the remote sensor comprises a set of RGB light sensors and an analog-to-digital converter for converting a sensed result of the set of RGB light sensors into the control signal.

7. The multimedia system of claim 5, wherein the display apparatus adjusts a gray level of the image during the white balance procedure.

8. The multimedia system of claim 5, wherein the display apparatus adjusts the brightness level of the light source during the white balance procedure.

9. The multimedia system of claim 8, wherein the light source comprises an LED lamp.

10. The multimedia system of claim 5, wherein the remote sensor and the wireless transmitter are integrated in a remote control device capable of communicating with the display apparatus.

11. The multimedia system of claim 5, wherein the wireless transmitter communicates with the wireless receiver via an IR signal or an RF signal.

12. A remote control device, comprising: sensor, for sensing a user environmental parameter, the remote sensor being provided near a user to sense the user environmental parameter around the user; and a wireless transmitter, coupled to the sensor, for transmitting a control signal corresponding to the user environmental parameter to a display apparatus;

wherein the display apparatus comprises a light source providing light for the apparatus, the display apparatus further comprises a near-end sensor for sensing a neighboring environmental parameter, the display apparatus receives the control signal from the wireless transmitter and the neighboring environmental parameter from the near-end sensor via wired transmission~ and the display apparatus adjusts a brightness level of the light source according to the received control signal and the neighboring environmental parameter to achieve a brightness adjustment for the display apparatus.

13. The remote control device of claim 12, wherein the user environmental parameter is selected from a group consisting of an environmental luminance and an environmental color temperature.

14. The remote control device of claim 12, wherein after receiving the control signal from the wireless transmitter, the display apparatus performs a white balance procedure for an image based on the control signal.

15. The remote control device of claim 12, wherein the wireless transmitter communicates with the display apparatus via an IR signal or an RF signal.

16. The remote control device of claim 12, wherein the remote control device comprises a set of RGB light sensors and an analog-to-digital converter for converting a sensed result of the set of RGB light sensors into the control signal.

* * * * *